US005564357A

United States Patent [19]

Peterson

[11] Patent Number: 5,564,357

[45] Date of Patent: Oct. 15, 1996

[54] INFLATABLE BOAT PROTECTIVE COVER

[76] Inventor: Leroy L. Peterson, 9222 Burt St., Apt. #215, Omaha, Nebr. 68114

[21] Appl. No.: 96,421

[22] Filed: Jan. 18, 1994

[51] Int. Cl.[6] ..... B63B 7/08

[52] U.S. Cl. ..... 114/345; 114/361

[58] Field of Search ..... 114/345, 361; 441/40, 66

[56] References Cited

U.S. PATENT DOCUMENTS

| | | | |
|---|---|---|---|
| 3,490,085 | 1/1970 | Lewis | 114/345 |
| 3,659,298 | 5/1972 | Edwards | 114/345 |
| 4,635,581 | 1/1987 | Scheurer | 114/345 X |
| 5,122,086 | 6/1992 | Remy | 441/66 |
| 5,279,510 | 1/1994 | Remy | 114/345 X |

*Primary Examiner*—Sherman Basinger

*Attorney, Agent, or Firm*—John A. Beehner Law Office

[57] ABSTRACT

A protective cover for an elongated inflatable boat includes a flexible enclosure having a bottom wall of a size and shape to span the floor and underside of the inflatable main chamber of the boat. A top wall extends upwardly and interiorly from the bottom wall to define a peripheral pocket adapted to receive and be substantially filled by the boat main chamber. The top wall has a large elongated opening positioned for registration with the open topped passenger compartment of the boat to enable passenger ingress and egress from the boat. A towing system is secured to the top wall adjacent the front of the protective cover for attaching a tow rope to the covered boat such that towing forces are distributed by the flexible enclosure across a substantial surface area to minimize stress on the boat. Handles may be provided on the top wall adjacent the elongated top opening, or if the inflatable boat includes integral handles and oar locks, the fabric top wall may simply have openings positioned for registration with the boat handles and oar locks.

12 Claims, 2 Drawing Sheets

INFLATABLE BOAT PROTECTIVE COVER

BACKGROUND OF THE INVENTION

The present invention is directed generally to inflatable boats and more particularly to a protective cover for encapsulating an inflatable boat for improved towing and puncture resistance.

Inflatable boats are in common use for recreation, fishing and transport to and from larger boats. The popularity of these boats is in part attributable to their relatively inexpensive price, as well as the fact that they can be deflated for storage in a minimal amount of space. The primary shortcoming of said inflatable boat is their susceptibility to puncture and the resultant danger and inconvenience accidental puncture presents. Furthermore, such boats are generally constructed to permit towing only at slow speeds or in emergencies. They are generally ill-suited for use as a recreational towable inflatable for relatively high speed towing behind a power boat.

Popular towable inflatables are the new tubes, or rings as they are called, which include either a PVC or rubber inner tube situated within a fabric cover having a towing strap extended from one edge for connection to a power boat or the like. But such rings are not designed to accommodate more than one passenger; the circular covers cannot accommodate an oblong boat; and the rings are not designed for rowing or for attachment of a motor for independent water transportation. Rather, they are designed strictly as a towable inflatable or as a toy on which children can recreate.

Accordingly, a primary object of the present invention is provide a protective cover for an elongated inflatable boat.

Another object is to provide such a protective cover with a towing system which enables towing of a inflatable boat behind a power boat without undue stress at the connection of the towing system.

Another object is to provide such a protective cover which enables use of inflatable boats and conditions which would create risk of puncture for conventional inflatable boats.

A related object is to provide a protective cover which reinforces and strengthens the inflatable boat, as well as adding puncture resistance, for enabling use of the boat for traversing weeds, submerged articles and the like safely.

Another object is to provide such a cover which enables selected attractive color graphics to be applied to an otherwise drab or single colored inflatable boat.

Another object is to provide a protective cover for an elongated inflatable boat which provides handles for secure positioning of a passenger in a boat enclosed by the cover.

Another object is to provide such a cover with opening positions for registration with handles and oar locks on the boat to be covered.

Another object is to provide an inflatable boat including a protective cover which adds puncture resistance as well as improved towing capability thereto.

Another object is to provide such a protective cover which is simple in construction, economical to manufacture and efficient in operation.

SUMMARY OF THE INVENTION

The present invention is a protective cover for an elongated inflatable boat having an inflatable peripheral main chamber in floor, together defining an open topped passenger compartment having a length substantially greater than the width thereof. The cover is an open topped flexible enclosure of a size and shape to conform to and be substantially filled by an elongated inflated boat. A bottom wall of the enclosure has a size and shape to span the floor and underside of the main chamber of the inflatable boat and the top wall of the enclosure extends upwardly and interiorly from the bottom wall so that together they define a peripheral pocket adapted to receive and be substantially filled by a boat main chamber. The top wall has an opening positioned for registration with the open topped passenger compartment of the boat to enable passenger ingress and egress to and from the boat within the cover.

The protective cover may be provided with a towing system for attaching a tow rope to the flexible enclosure in a way that towing forces are distributed by the enclosure across the substantial surface area of the inflatable boat to minimize stress on the boat. That tow system preferably has a loop at one end for connection to a tow rope and a pair of strap portions diverging rearwardly for connection to the enclosure at transversely spaced apart positions, thereby to minimize side to side movement of a boat within the cover upon towing forces being exerted through a towing system.

The large opening in the top wall is preferably larger than the area of the open topped passenger compartment of the boat, as measured at the interiormost peripheral edge of the passenger compartment. The top wall may additionally be provided with small openings in registration with handles on the boat or in registration with oar locks on the boat to accommodate the use of these features when a boat having such features is enclosed within the protective cover.

The flexible enclosure is preferably made of a tough fabric material such as nylon to thereby strengthen and reinforce the inflatable boat, as well as provide puncture resistance for traversing shallow areas where obstacles may be encountered.

DESCRIPTION OF THE PREFERRED EMBODIMENT

Figure 1:
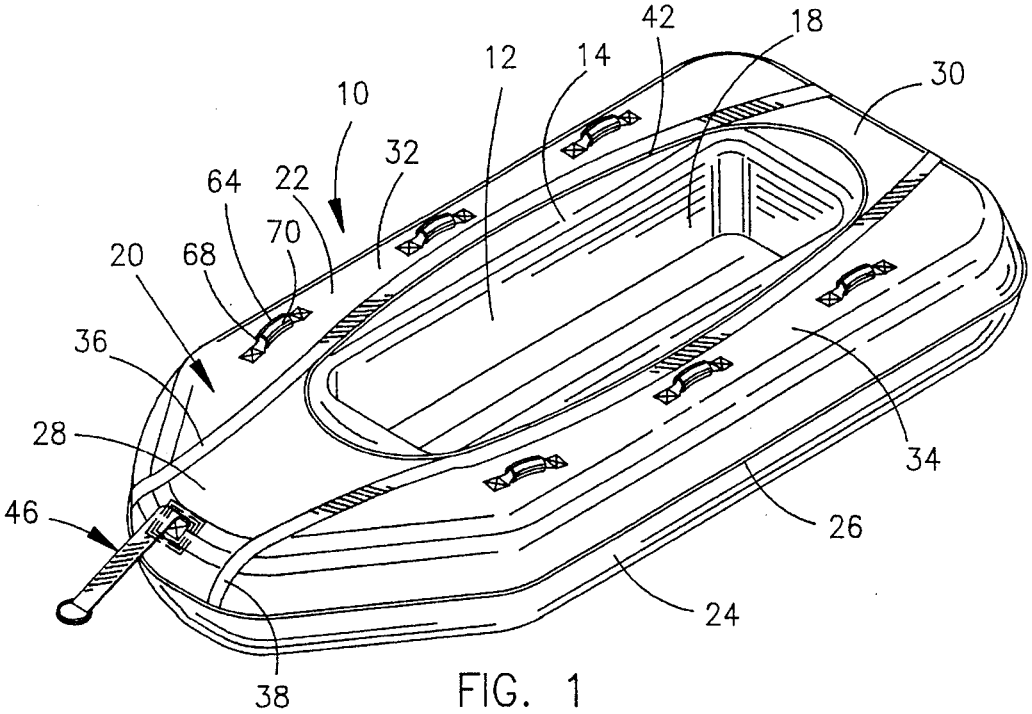
FIG. 1 is a perspective view of an elongated inflatable boat covered by the protective cover of the invention.
Figure 2:
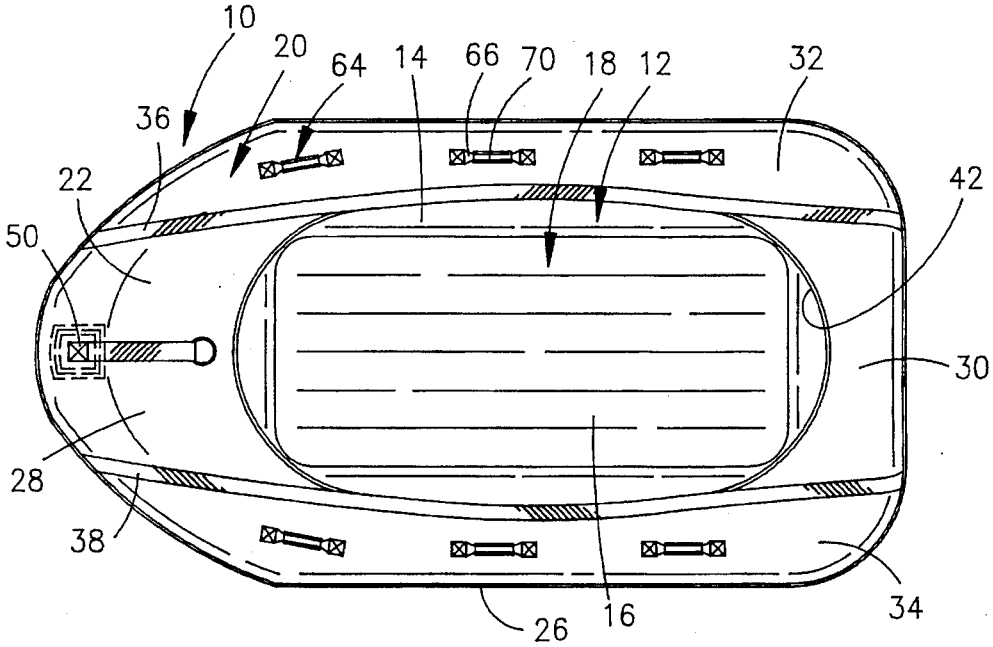
FIG. 2 is a top plan view of the combination boat and cover of FIG. 1.
Figure 3:
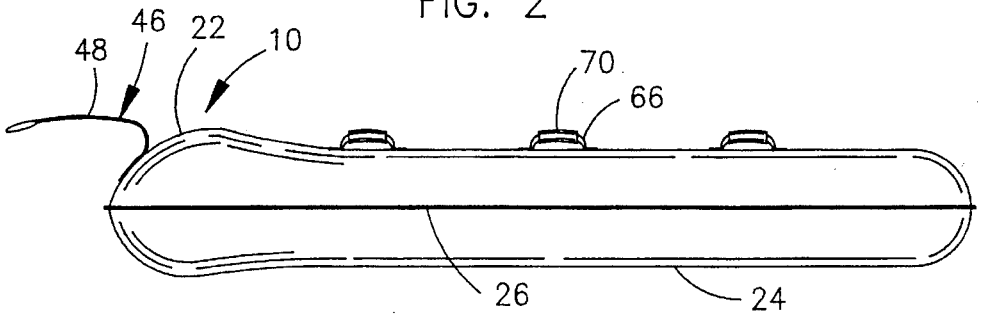
FIG. 3 is a side elevational view thereof.
Figure 4:
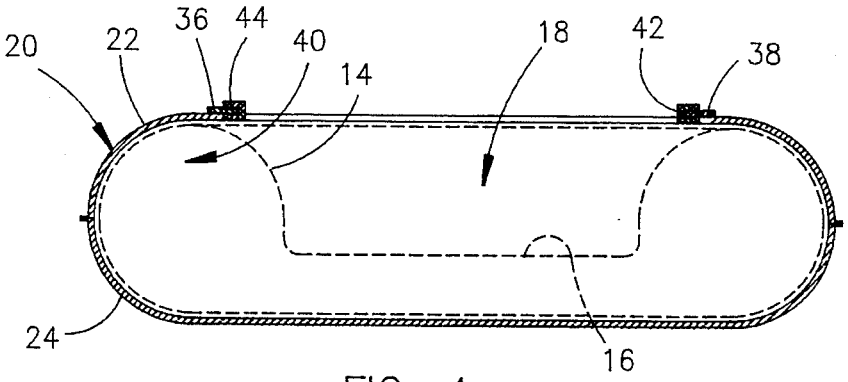
FIG. 4 is an end sectional view thereof.

The protective cover 10 of the present invention is illustrated in the drawings in combination with an elongated inflatable boat 12 which may be of conventional construction according to any of the various commercially available inflatable boats. In the most common construction, the front wall, the back wall and both side walls of the boat define a single inflatable peripheral main chamber 14. An inflatable floor 16 may be provided as a separate insert or may be heat sealed to the main chamber to provide an integral boat construction with multiple inflatable chambers. For safety, the main chamber may be constructed so as to comprise more than one inflatable chamber. The peripheral main chamber and floor collectively define an open topped passenger compartment 18 having a length substantially greater than the width thereof, thereby to accommodate 2, 3, 4 or more passengers situated front to back, one behind the another.

The protective cover 10 includes a flexible enclosure 20 having a top wall 22 and bottom wall 24. Whereas in the illustrated embodiment, the top wall 22 and bottom wall 24 are connected along the peripheral edges by a seam 26, the terms "top wall" and bottom wall" are simply used for convenience and are not intended to be limited according to the construction of any particular embodiment of the invention. The seams may be arranged at any selected position, for function, aesthetics or efficient fabric use. An advantage of the illustrated embodiment is that the bottom wall 24 is a single seamless fabric sheet so as to present no seams or other obstructions which could engage obstacles in the water. The exterior peripheral seam 26 preferably connects the top and bottom walls by interlocking double stitching with binding along the length of the seam.

Bottom wall 24 is of a size and shape to span the floor 16 and underside of the main chamber 14 of the inflatable boat 12.

In the illustrated embodiment, top wall 22 is formed of a front panel 28, rear panel 30 and opposite elongated side panels 32 and 34. Each side panel is connected to the front and rear panels 28 and 30 by binding strips 36 and 38 and appropriate stitching.

Top wall 22 is of a size and shape so that it extends upwardly and interiorly from the bottom wall 24 thereby to define a peripheral pocket 40 which is adapted to receive and be substantially filled by the boat main chamber as illustrated in FIGS. 1 through 4. Top wall 22 has a large opening 42 which is elongated front to back and of a size and position for registration with the open topped passenger compartment 18 to enable passenger ingress and egress from the boat 12. The peripheral edge of top opening 42 may be reinforced and protected by binding 44 (FIG. 4) which is folded in a C-shaped and stitched to the top wall and binding strips 36 and 38 for tough construction which will resist freying and damage during the long useful life of the cover end boat.

The material of the flexible enclosure 20 is preferably a synthetic fabric material such as nylon, polyester, or dacron. An acceptable fabric is a 600 D nylon commercially available under the name cordura. Alternate nylon fabrics may range from approximately 420 D to approximately 1,000 D and that fabric may be provided with PVC coating on the interior surface thereof. The various exterior surfaces of the flexible enclosure 20 afford ample surface area for colorful graphics, written indicia, advertisements or the like, all of which compliment the fabric covering to provide increased visibility for safer operation.

A towing system 46 is provided on the protective cover 10 for attaching a tow rope to the covered boat 12 in a way that the towing forces are distributed by the enclosure 20 across a substantial surface area of the boat 12 to minimize stress on the boat. Uncovered boats may be provided with a molded towing ring heat sealed to the front of the boat such that towing forces would tend to stretch and potentially rupture the front panel of the boat. To the contrary, the towing system of the invention is secured to the front of the flexible enclosure 20 such that towing forces cause the entire front portion of the enclosure to compress the boat main chamber 14 both vertically and transversely thereby reinforcing the walls of the boat at the very time when reinforcement is most needed.

Figure 5:
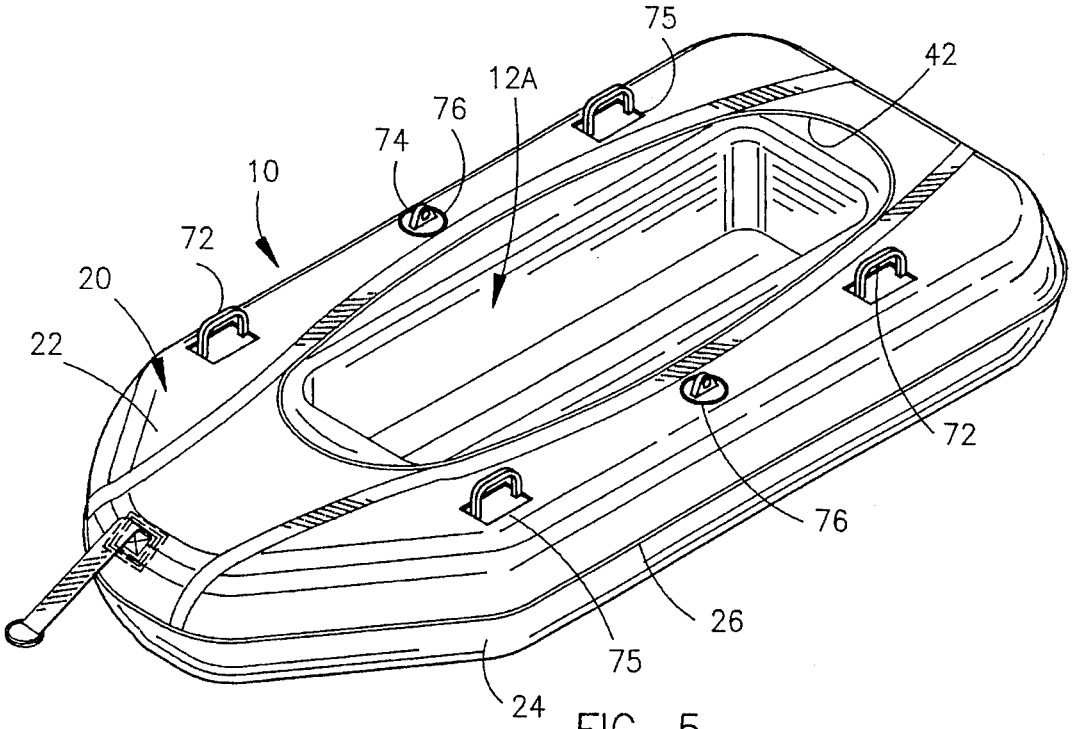
FIG. 5 is a perspective view of an alternate embodiment of the invention wherein the protective cover includes holes in registration with handles and oar locks on the boat itself.
Figure 7:
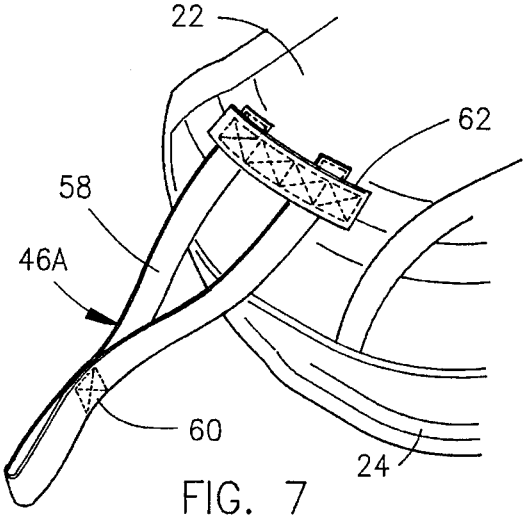
FIG. 7 is an enlarged detail partial perspective view showing an alternate tow strap for the cover of the invention.
Figure 6:
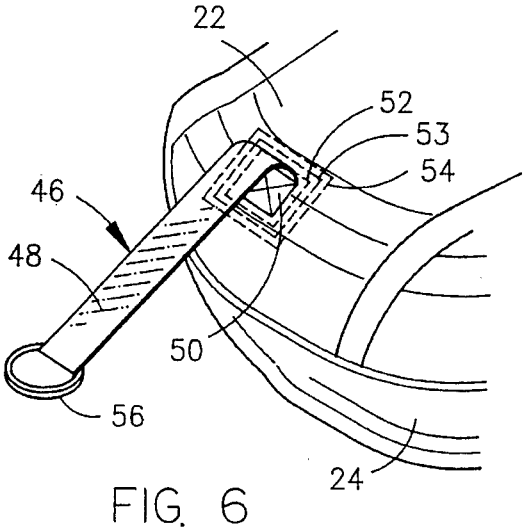
FIG. 6 is an enlarged detail partial perspective view of one tow strap of the invention.

One embodiment of a towing system is illustrated in FIGS. 1, 5 and 6 wherein a strap 48 has one end secured by stitching 50 to top wall 22 at a central position with three underlying fabric patches 52, 53 and 54 underlying the top wall 22 at the point of attachment for reinforcement. A forward free-end of the strap 48 is doubled back over a D-ring 56 or O-ring to provide a loop for attachment to a tow rope. An alternate embodiment of a towing system 46A is illustrated in FIG. 7 wherein a single elongated strap 58 is folded in half and stitched together at 60 in spaced relation from the fold to provide a loop for connection to a tow rope. The two ends of the folded strap are securely attached by stitching to top wall 22 at transversely spaced apart positions on opposite sides of a center line through the boat to minimize side to side movement of the boat upon towing forces being exerted through the towing system 46A. A cross-strap 62 preferably overlays the opposite ends of strap 58 and is stitched to the top wall 22 through the ends of strap 58 for a more secure connection and one which distributes the towing forces over a greater area of the fabric top wall 22. The connection to the top wall at a position above the peripheral pocket 40 at the front of the boat minimizes lifting of the front end of the boat by towing forces. It is preferred that the position where the towing system is attached be above and rearwardly of the forwardmost edge of the flexible enclosure 20 when a fully inflated boat is secured therein.

Handles 64 may be provided on the enclosure, preferably on top wall 22, so that passengers can secure themselves as the boat is towed through the water. It is preferred that a plurality of pairs of handles 64 be provided, each pair generally symmetrically arranged on opposite sides of the top wall 22 adjacent top opening 42, with the pairs arranged in longitudinal spaced apart relation. The front pair of handles may be secured adjacent the front of top opening 42 with the other pairs spaced rearwardly behind them at positions comfortable for passengers seated in the boat. Each handle 64 may be formed from a single strip of webbing 66 stitched to the top wall 22 at opposite ends. Between the stitched ends, the webbing may be covered by an interior PVC sleeve 68 and an exterior foam sleeve 70 for a secure comfortable grip.

In the alternative, for a boat 12A which may be provided with handles 72 and oar locks 74 as illustrated in FIG. 5, the handle means for the boat 12A may simply be a plurality of pairs of openings positioned for registration with the handles 72. Likewise, an additional pair or pairs of opening 76 may be provided at positions for registration with the boat oar locks 74 as illustrated.

Whereas the protective cover an elongated inflatable boat has been shown and described herein in connection with preferred embodiments thereof, it is understood that many modifications, additions and substitutions may be made which are within the intended broad scope of the appended claims.

I claim:

1. In combination, an inflatable boat including a single inflatable peripheral main chamber and an inflatable floor defining a single open topped passenger compartment having a length substantially greater than the width thereof, and a protective cover comprising, a flexible enclosure having top and bottom walls and being shaped to conform to and be substantially filled by said inflatable boat upon inflation thereof, said bottom wall having a size and shape to span the inflatable floor and the underside of said single inflatable peripheral main chamber of said inflatable boat, said top wall extending upwardly and interiorly from said bottom wall to define a peripheral pocket adapted to receive and be substantially filled by said boat single inflatable peripheral main chamber, and said top wall having an opening positioned for registration with said single open topped passenger compartment to enable passenger ingress and egress to and from said boat, and tow means for attaching a tow rope to said flexible enclosure whereby towing force is distributed by said enclosure across a substantial surface area of the inflatable boat to minimize stress on said boat.

2. The protective cover of claim 1 wherein said flexible enclosure is made of a tough fabric material to reinforce said inflatable boat and resist puncture thereof.

3. The protective cover of claim 2 wherein said flexible enclosure is formed of nylon fabric.

4. The combination of claim 1 wherein said tow means comprises loop means adapted for connection to a tow rope and means for securing said loop means to said top wall at a position above said peripheral pocket to minimize lifting of the front end of a boat by towing forces.

5. The protective cover of claim 4 wherein said means for securing said loop means comprises first and second strap portions connected to said loop means at forward ends thereof and having rearward ends connected to said top wall at transversely spaced apart positions to minimize side to side movement of a boat within said cover upon towing forces being exerted through said tow means.

6. The combination of claim 4 wherein said tow means comprises an elongated strap connected to and extending forwardly of said flexible enclosure, said strap having a free end connected to said loop means and an opposite end secured to said top wall.

7. The protective cover of claim 1 wherein said opening in the top wall is larger than the area of the open topped passenger compartment of a boat taken at the interiormost peripheral edge thereof.

8. The protective cover of claim 1 further comprising handle means on said top wall.

9. The protective cover of claim 8 wherein said handle means comprises a plurality of pairs of handles, each pair generally symmetrically arranged on opposite sides of said top wall and said pairs arranged in longitudinally spaced apart relation.

10. A protective cover for an elongated inflatable boat including an inflatable peripheral main chamber and floor defining an open topped passenger compartment having a length substantially greater than the width thereof, said cover comprising, a flexible enclosure having top and bottom walls and being shaped to conform to and be substantially filled by an inflated inflatable boat, said bottom wall having a size and shape to span the floor and underside of main chamber of an inflatable boat, said top wall extending upwardly and interiorly from said bottom wall to define a peripheral pocket adapted to receive and be substantially filled by a boat main chamber, and said top wall having an opening positioned for registration with said open topped passenger compartment to enable passenger ingress and egress to and from a boat with said cover, and handle means on said top wall, said handle means comprising a plurality of pairs of openings positioned for registration with handles on an inflatable boat within said cover.

11. The protective cover of claim 10 wherein said top wall further comprises openings positioned for registration with oar locks on an inflatable boat within said protective cover.

12. In combination, an inflatable boat including an inflatable peripheral main chamber and floor defining an open topped passenger compartment having a length substantially greater than the width thereof, and a protective cover comprising, a flexible enclosure having top and bottom walls and being shaped to conform to and be substantially filled by said inflatable boat upon inflation thereof, said bottom wall having a size and shape to span the floor and the underside of said main chamber of said inflatable boat, said top wall extending upwardly and interiorly from said bottom wall to define a peripheral pocket adapted to receive and be substantially filled by said boat main chamber, and said top wall having an opening positioned for registration with said open topped passenger compartment to enable passenger ingress and egress to and from said boat, and handle means on said top wall, said boat including a plurality of handles and oar locks thereon and said handle means comprises a plurality of pairs of openings positioned for registration with said handles and at least a pair of openings in registration with said oar locks on said inflatable boat.

* * * * *